US005351428A

United States Patent [19]

Graham

[11] Patent Number: 5,351,428

[45] Date of Patent: Oct. 4, 1994

[54] COLLAPSIBLE LIGHTWEIGHT RIFLE

[76] Inventor: John A. Graham, 5922 Kimbrough St., Corpus Christi, Tex. 78412

[21] Appl. No.: 125,749

[22] Filed: Sep. 24, 1993

[51] Int. Cl.[5] ..... F41C 23/04

[52] U.S. Cl. ..... 42/72; 42/77; 42/106

[58] Field of Search ..... 42/72, 77, 106

[56] References Cited

U.S. PATENT DOCUMENTS 3,543,429 12/1970 Bendele et al. ..... 42/77
3,685,194 8/1972 Coon ..... 42/77
4,299,046 11/1981 Atchisson ..... 42/75.04
4,368,589 1/1983 A'Costa ..... 42/77
4,663,876 5/1987 Reaume ..... 42/72
5,305,539 4/1994 Von Kuster ..... 42/72

*Primary Examiner*—David Brown

[57] ABSTRACT

A small, extremely light weight kit containing components which, when wholly assembled, are a fully functional rifle, easily assembled in five minutes or less, and stowable in kit form with among other survival items, up to fifty rounds of small caliber ammunition, which is highly portable and useful.

1 Claim, 4 Drawing Sheets

COLLAPSIBLE LIGHTWEIGHT RIFLE

BACKGROUND OF INVENTION

1. Technical Field

This invention relates generally to firearms and more particularly to an extremely lightweight collapsible rifle, easily assembled and packed in such a compact manner as to be comfortably carried, when packed, in different areas of clothing or on the person.

2. Background Information

It's desirability is primarily in its use in an emergency situation in the field or as a survival tool, while maintaining compliance with existing firearms laws and legislation, and the potential for its uses are far-reaching. The term "collapsible rifle" is commonly used in reference to a firearm primarily intended for use in unexpected or emergency situations. Aviators, boaters or campers in wilderness locations for whatever reason may deem it impractical to carry a heavy or bulky conventional rifle, but in emergency situations may want a rifle with obviously more accuracy than a handgun, to provide food or protection or as an emergency signalling device. This type of rifle should be very lightweight and capable of being carried in a small package of utmost convenience. It should also be assembled directly from the kit in which it is packed, and be capable of supplying a sufficiently large amount of ammunition. Examples of some rifles which meet some but not all of the above criteria include U.S.A.F. M4 .22 Hornet bolt action rifle, Armalite-Charter AR-7 .22 caliber semi-automatic rifle, U.S.A.F. M6 .22/.410 over-under survival rifle and the Garcia "Bronco" single shot. These are generally large, bulky, expensive, and heavy, not easily assembled and frequently unusable under adverse conditions.

SUMMARY OF INVENTION

An object of this invention is to provide a new and improved assembly of various parts into an ultra-lightweight durable rifle which is inexpensive to manufacture and operate, easily compacted inside a small container, easily transportable, and readily available for emergency, survival, or sporting conditions.

Another object of this invention is to provide a self-contained lightweight rifle to be used in obtaining small game, self protection and/or signalling for help in emergency situations. It can be made available in either rim or center fire and manufactured from inexpensive materials and includes capability of carrying fifty or more small caliber cartridges. Briefly, in accordance with accompanying illustrative embodiments of this invention, the foregoing and other objects are obtained by providing components for assembly of a rifle of legal legislated length, having assembleable parts, which when attached together, following simple instructions, provide a usable rifle having a distinct advantage in weight, compactness, and portability. Many other advantages and objects of the present invention will become fully obvious as following detailed descriptions unfold when observed in conjunction with accompanying drawings and illustrations.

DESCRIPTION OF THE PREFERRED EMBODIMENTS

Figure 1:
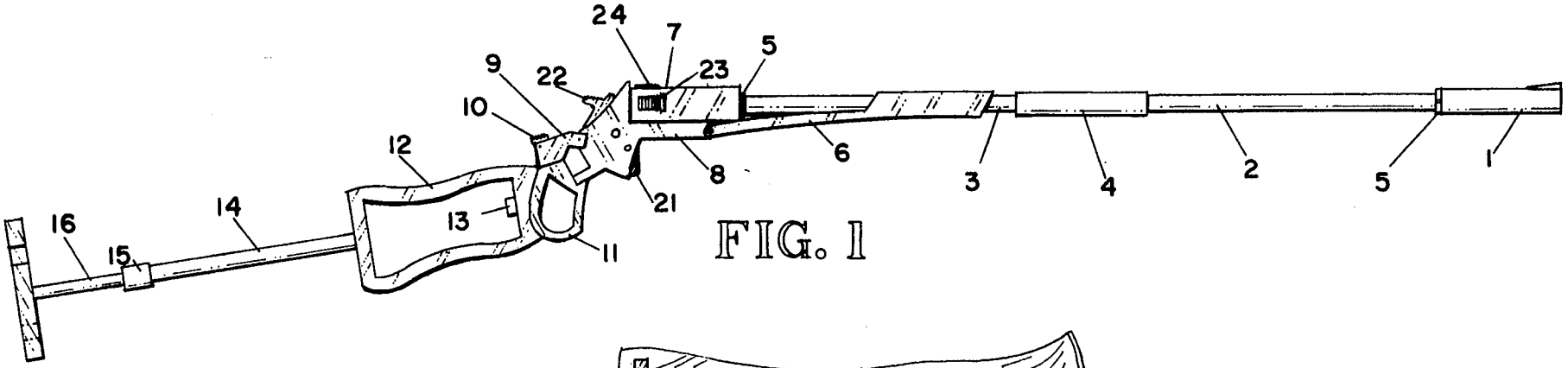
FIG. 1 is a view of the rifle, as assembled and is about one-third actual size.
Figure 1A:
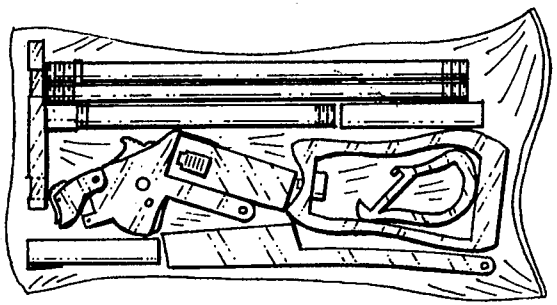
FIG. 1A is a view of the disassembled rifle in "kit form" placed in a small, compact configuration.
Figure 2:
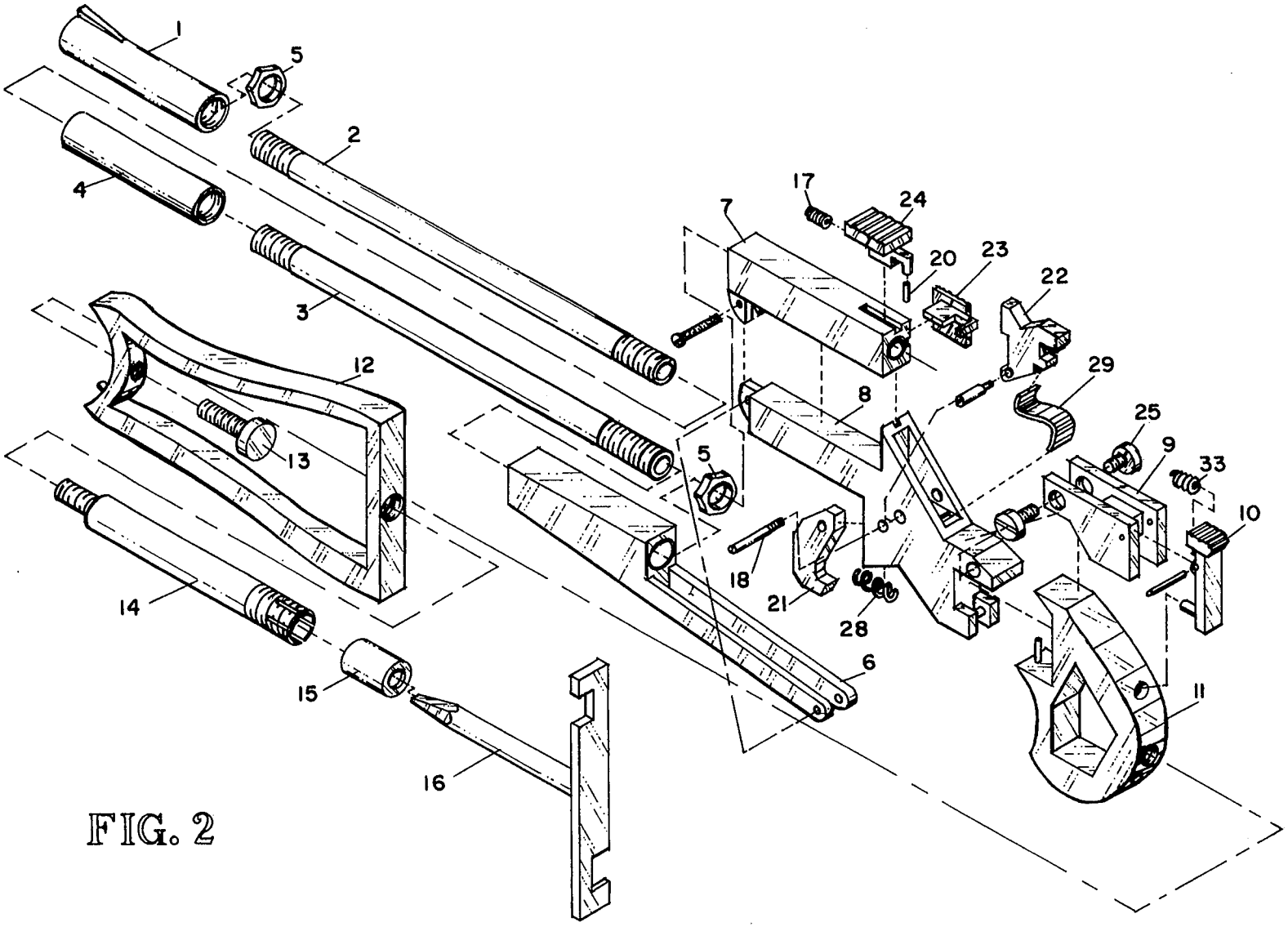
FIG. 2 is a view of all parts, assembled and/or disassembled.
Figure 3:
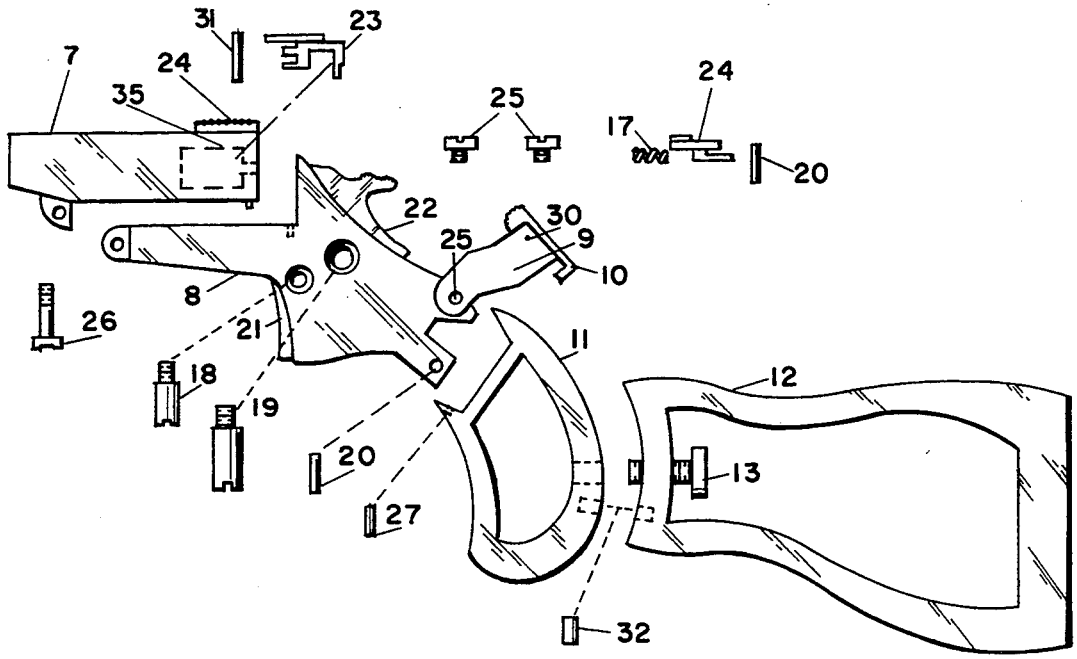
FIG. 3 is a view of the frame components and attachments, approximately actual size.
Figure 4:
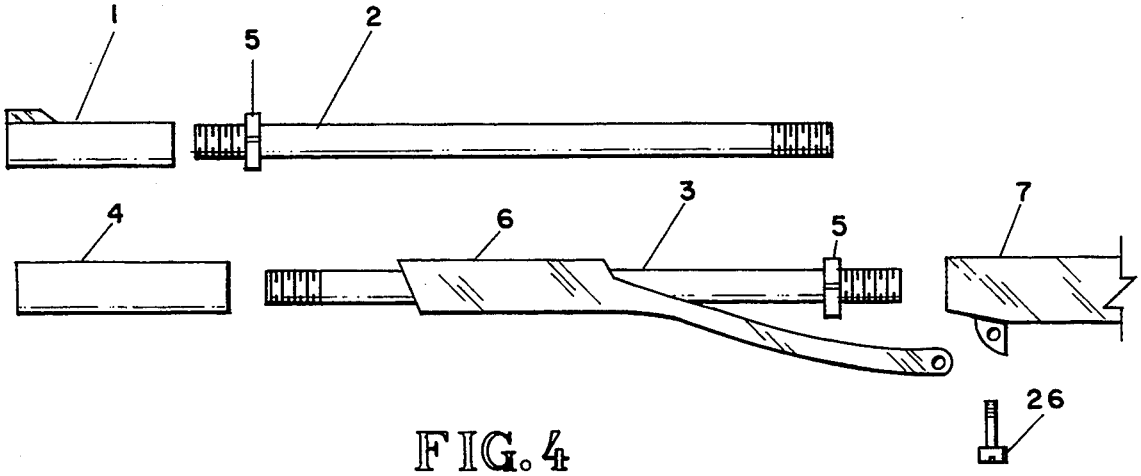
FIG. 4 is another view of barrel assembly parts, disassembled, and approximately two-thirds actual size.
Figure 5:
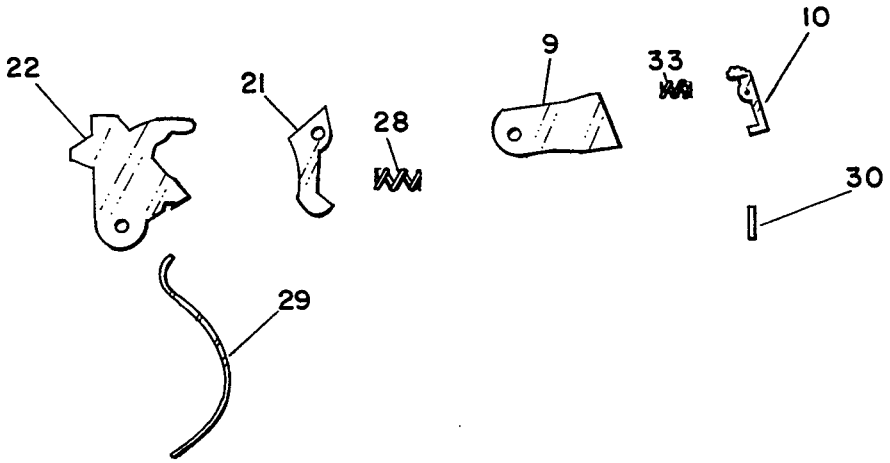
FIG. 5 is a view of internal and external working parts of the trigger and firing mechanism, shown actual size.
Figure 6:
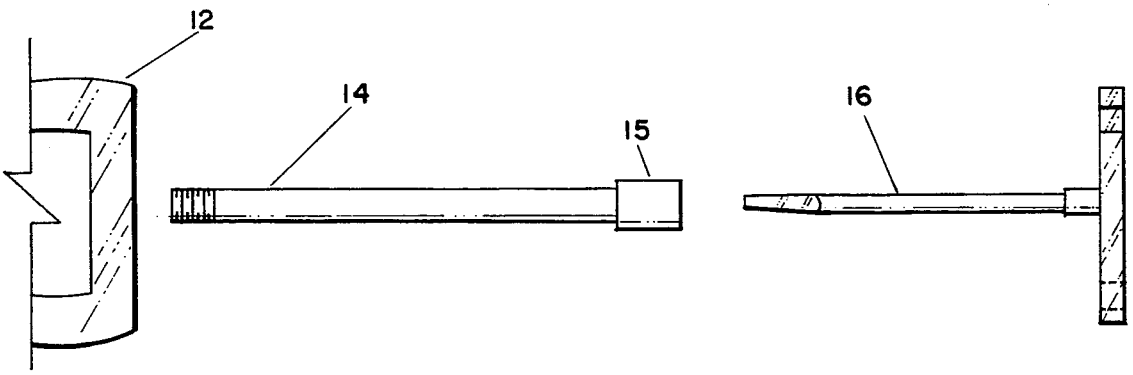
FIG. 6 is a view of the stock extension parts, shown approximately two-thirds actual size.

Referring now to the drawings wherein like reference characters designate identical or corresponding parts throughout the several drawings, and particularly to the Frame 8 from which the assembly basically begins; when assembling the Rifle 34, the front end of the #3 Barrel Tube 3 is placed through the saddle area of the Barrel Support 6. With a Jam Nut 5 in position, the #3 Barrel Tube 3 being externally threaded on both ends as is the #2 Barrel Tube 2, is inserted and attached to the front end of the Barrel-Chamber 7 which has a matching internal ⅜"-24 thread, hand tightened, and the Jam Nut 5 brought up snugly against the front end of the Barrel-Chamber 7.

A Threaded Sleeve 4 having an outside diameter of 7/16" and an internal ⅜"-24 thread throughout its length of 2½, is then placed onto the front end of the #3 Barrel Tube 3 and hand tightened. The rear end of the #2 Barrel Tube 2 is then placed into the front end of the Threaded Sleeve 4 and hand tightened. The front end of the #2 Barrel Tube 2 having a pre-installed Jam Nut 5 is now ready for installation of the Front Sight 1, the Front Sight 1 being also internally threaded at the rear end with a ⅜"-24 thread. The Front Sight 1 is placed threaded end first onto the front end of the #2 Barrel Tube 2, more or less aligned with the Rear Sight-Lock 24 and the Jam Nut 5 hand tightened to hold a position of alignment. The Jam Nuts 5 are equipped with internal ⅜"-24 threads.

All assembled components are now made positively tight utilizing the ⅜" and 5/32" calibrated wrench areas located and machined into the rear end of the Stock Extension Shaft 16 "T" configuration.

The Barrel Support 6 rear end contains an alignment pivot hole which matches similar pivot holes in the bottom of the Barrel-Chamber 7 and the extreme end of the Frame 8. When these parts are placed together for assembly and the holes are in alignment, the Barrel-Frame-Support Pivot Screw 26 is installed and gently secured by using the screw driver end of the Stock Extension Shaft 16. The Rear Sight-Lock 24, being pre-installed and secured into the top rear area of the Barrel-Chamber 7 by means of a Rear Sight Retaining Pin 35 is activated by applying thumb or finger pressure and pushing the Rear Sight-Lock 24 toward the forward end of the assembly. When activated, the locking area of the Rear Sight Lock 24 is removed from its mating areas located just below the top of the Frame 8 allowing the Barrel-Chamber 7 and the rest of the assembly to open in a tipped-up configuration exposing the chamber area of the Barrel-Chamber 7 which is now ready to accept or eject a cartridge, live or spent.

With the Barrel-Chamber 7 open, the Ejector 23 which is located at the left rear side of the Barrel-Chamber 7 can now be activated by movement toward the rear of the Barrel-Chamber 7, being moveable to a distance of approximately $\frac{3}{8}''$. The Ejector 23 should be returned to the seated position by simply moving it into place prior to loading or closing of the Barrel-Chamber 7.

When closing the Barrel-Chamber 7, thumb or finger pressure should again be exerted against the rear Sight-Lock 24, the tipped-up barrel assembly closed, and the pressure released from the Rear Sight-Lock 24 which allows the actual locking area of the Rear Sight-Lock 24 to enter into a mated hole located just below the top of the Frame 8 and in alignment with the locking area of the Rear Sight-Lock 24. The Trigger 21 and the Hammer 22 are pre-installed. Each is held in place by screws. The Trigger Screw 18 and the Hammer Screw 19 are 3/16" diameter by 9/16" in length, each having a slotted end and a threaded end. The thread size for each is 8–32 with a thread depth of 3/16". The Trigger 21 is pre-equipped with a Trigger Spring 28 located in the lower rear area of the Trigger 21.

Hammer 22 tension is obtained by means of an "S" shaped flat spring, herein referred to as the Hammer Spring 29. This spring has a small, tapered end at its top and a wider base, with an overall length of approximately $2\frac{1}{4}''$. The Hammer Spring 29 is inserted through the back of the Frame 8 and positioned against a pivotal area in the rear of the Hammer 22 and designed to accommodate the narrow end of the Hammer Spring 29. The wider base of the Hammer Spring 29 is seated into a machined area located on the inside front lower area of the Butt 11, and can be installed at the same time as the installation of the Butt 11 by placing the Hammer Spring 29 into the machined area of the Butt 11 and applying upward pressure against the Hammer Spring 29 and the Butt 11 when attaching the Butt 11 to the Frame 8. The Hammer Spring 29 may also be installed after the attachment of the Butt 11 is completed.

The Butt 11 is installed by means of a Butt Anchor Stud 27 located in the lower front area of the Butt 11 which engages the Butt-Frame Lockbar 20. The Butt 11 is gently lifted upward using a pivotal type action and the Butt Lock 9 secures the Butt 11 to the Frame 8. The Butt Lock 9 is a channeled unit and is attached to the top rear of the Frame 8 by means of two Butt Lock Screws 25. The Butt Lock 9 contains a Butt Locking Lever 10, a Butt Locking Lever Spring 33 and the Butt Locking Lever Retaining Pin 30. The Butt Locking Lever 10 is instrumental in maintaining the Butt 11 to the Frame 8 as shown in the illustrations. In assembling, the Butt Extension 12 is attached to the Butt 11 by placing the Butt Extension Anchor Stud 32 on the front end of the Butt Extension 12 into a mating hole located in the upper rear area of the Butt 11 and tightening the Butt Extension Securing Screw 13 with the thumb and finger until secure.

The Butt Extension 12 rear center area is also equipped with an internal $\frac{3}{8}''$-24 thread designed to accommodate the Stock Extension Tube 14 which has an external $\frac{3}{8}''$-24 thread on the forward end and a collet on the rear end. The Stock Extension Tube 14 is installed onto and hand tightened snugly into the Butt Extension 12. The Extension Tube Collet 15 is equipped with an internal $\frac{3}{8}''$-24 thread which matches the $\frac{3}{8}''$-24 external thread on the rear end of the Extension Tube Collet 15, a 3/16" hole is located, designed to accept the Stock Extension Shaft 16. With the Stock Extension Shaft 16 inserted into the collet end of the Stock Extension Tube 14, the Extension Tube Collet 15 can be hand tightened to secure the Stock Extension Shaft 16 in the desired position. This action completes the assembly of the Collapsible Lightweight Rifle 34. Total assembled weight is 1.25 lbs or less, and this Rifle 34 is contained, when disassembled into a package with dimension of approximately 8 inches by $2\frac{7}{8}$ inches by $1\frac{1}{8}$ inches.

It will be obvious to anyone informed about firearms, and rifles in particular, that other variations can be made in the embodiment chosen for purpose of illustration in presenting the invention without departing from the scope thereof, as defined by the attendant claims.

What is claimed as invention:

1. A collapsible lightweight rifle comprising: a barrel support having a barrel supporting saddle end and a pivot screw end, a barrel and chamber section having a muzzle end and a rear sight end, and left and right sides; said barrel section having a threaded portion extending into said barrel and chamber section being concentrically aligned with a bullet chamber which comprises a hole drilled mid-way between said rear sight end of said barrel and chamber section and extending through a plane being at the rear most end in line with a perpendicular plane of said threaded portion and a flanged area formed at said muzzle end; a take-down or break-down barrel comprising three elongated tubes two of which are seven and three-eighths inches long by about $\frac{3}{8}$ inch outside diameter and the third of said elongated tubes being $2\frac{1}{4}$ inches long, said tubes comprising first, second, and third elongated tubes, each having front and rear ends and internal and external walls, said second and third tubes having flat areas machined near rear threaded area to accommodate tightening when assembled, said first tube comprising a front sight and said first tube further having a barrel mating surface containing a flanged area on its rear end, said rear end being threaded on the internal wall, said second tube front end comprising barrel mating means being external threads, thus forming barrel mating surface for means of mating with first elongated tube rear end, a jam nut threaded onto said second tube front end for securing said tubes in a mated formation or configuration; the third of said elongated tubes further comprising similar mating means, being a threaded portion of said second tube rear end exterior wall for connecting said second tube to the front end of the third elongated tube front end by means of a threaded sleeve being about 9/16" outside diameter by about three inches long, having internal and external walls, said threaded sleeve having front and rear ends, said walls being threaded internally with threads, said threads to match designated ends of said elongated tubes, and designed to connect said second and third tubes, said third tube further comprising mating means on said third tube rear end for connecting said tube into front end of barrel-chamber section; said barrel chamber section, said barrel support, and a frame, each having holes used in pivoting action being aligned for purposes of installing a pivot screw, said holes being located as follows: extreme rear end of said barrel support, extreme front end of said frame, bottom forward area of said barrel-chamber unit, said holes, when aligned, will receive said pivot screw, said pivot screw inserted and gently tightened with screw driver provided, which comprises the ground front end of butt extension shaft, said pivot screw secured parts completing front section assembly of unit, said barrel and frame now comprising several parts and accessories: said barrel-chamber having a steel spring activated rear sight-locking device comprising a sighting area on it's top, and further comprising a locking area located on bottom of said sight-lock and protruding from its position at the top, rear area of said barrel-chamber, said rear area being in alignment with matching hole in said frame, thus allowing positive alignment and locking of said barrel-chamber to said frame when said barrel-chamber is closed, said sight locking device activated by means of thumb or finger pressure of said rear sight-locking device, said pressure being applied toward front or muzzle end of unit, releasing pressure on said rear sight-locking device after closing said barrel-chamber which places said unit in a secure configuration when protruding area of said sight-locking device re-enters alignment hole in said frame, said barrel-chamber accepting said sight-locking device by means of a drilled and slotted hole located on rear of barrel-chamber above said chamber area and drilled to a depth of about ½", said rear sight locking device retained by a retaining pin located at top rear of said barrel-chamber section and protruding left to right through said sight-locking device, said sight-locking device being slotted to accept said retaining pin, said pin a means of keeping said sight-locking device in place, thus assuring secure position with said frame when said barrel-chamber is closed and said sight-locking device is released, said barrel-chamber further comprises: a steel ejector unit located on left rear side of barrel-chamber, said ejector being secured in said barrel-chamber unit by means of a retaining pin inserted through a drilled hole, said hole being drilled from top of said barrel-chamber and through said barrel-chamber, said retaining pin when installed protrudes from bottom of said barrel-chamber to a depth of about ⅛", being further utilized as a barrel-frame alignment pin entering into a similar sized hole drilled in exact alignment into said frame through said barrel, as means to guide said barrel-chamber unit to a stabilized position when barrel-chamber is closed against said frame, said frame further comprising holes and openings to accommodate further installation and mounting of said parts and accessories, comprising: a hammer, trigger, hammer spring having a narrow end and a wider end, trigger spring, butt, butt anchor stud, butt locking lever, butt lock, hammer screw, trigger screw, butt locking lever screws, barrel-frame alignment pin, stock extension tube, stock extension tube collet, stock extension shaft, butt extension securing screw, butt to frame lock bar, butt locking lever retaining pin; said hammer being step-notched on bottom bearing surface as means of maintaining safety and firing positions when said hammer is cocked or otherwise activated by thumb pressure, thereby defining a hammer action; said hammer being secured in said frame by means of a screw, said screw being inserted into side of said frame through a hole on left side of said frame and a threaded hole on right side in direct alignment with said left side hole, said screw entering through said hammer positioned inside said frame in alignment with said drilled hole as means of allowing pivoting of said hammer upon activation of said hammer, said hammer being forced against spring pressure by means of a flat "S" shaped spring being placed against said hammer into an accommodating grooved area, and based against aforementioned butt, said frame being channeled as means to accept said butt by means of a steel bar located in lower rear area of said frame and positioned in parallel configuration with all pivot points; a frame-butt assembly comprising: a butt lock mounted to upper rear area of said frame by means of said two butt lock screws located on either side of said frame, said butt lock rotates on mounting screws thus raising up at its point furthest from said mounting screws, and is further comprised of; a butt locking lever, spring activated, and maintained in butt lock by means of a retaining pin located through side of butt lock, entering into and through said butt lock from side to side, and said butt locking lever pivot hole, said butt lock comprising; a "U" shaped channel with solid, angled rear end, slotted to hold said butt locking lever and attached to rear of said frame by means of two aforementioned butt lock screws, said butt lock, when raised by means of thumb pressure against butt lock lever, accepts the butt by means of a butt anchor stud, said stud located on front lower lip of butt and proceeding through said area from side to side, said stud being designed to align with said aforementioned steel bar, and by lifting said butt upward from bottom with finger pressure and gently pushing said butt lock downward with thumb, said butt locking lever is activated and snaps into position by means of an alignment hole on upper, central location on back of said butt thereby securing said butt to said frame, and further allowing continued installation of aforementioned "S" shaped flat spring against rear area of said hammer, said spring being placed, small, narrow end first, into said frame from the side and by means of supplying a minor degree of lift torque and pressure against bottom of said spring, wider end of said spring can be positioned into spring slot located on inside bottom area of said butt thereby allowing said hammer to be activated by thumb pressure and maintaining constant pressure against said hammer, said hammer made to function in conjunction with said trigger, said trigger comprised of steel or other suitable wear-resistant material, said trigger having a pivot hole drilled in parallel alignment with and similar in configuration to said hammer alignment hole and said trigger having a screw, said screw having small and large ends containing a thread on said small end, said screw entering from left side of said frame, proceeding through said trigger which is positioned inside said frame in alignment with said hole in said frame and threaded into opposite side of frame by means of matching thread as means of allowing pivoting of said trigger when said trigger is activated by means of aforementioned hammer action, said trigger further activated by means of coil spring located in a drilled hole in lower rear area of said trigger: said frame-butt and assembly further comprising one drilled hole located on rear central portion of said butt, said hole being about ½" deep and being threaded internally for accepting a butt extension securing screw, said butt also having an alignment hole to accommodate an alignment stud located in forward lower area of said butt extension, said securing screw permanently located near center forward area of said butt extension comprising: a means to attach said butt extension to said butt by means of positioning said alignment stud into corresponding aforementioned hole, a butt extension securing screw threaded into said threaded hole in said butt, for securing said butt extension tightly against said butt, said butt extension securing screw further comprising: a plastic finger grip turning area approximately ½" in diameter on rear of said screw for means of tightening said butt and said butt extension together; said butt extension comprised of any material suitable to allow proper function and lightness of weight, said butt extension being approximately $3\frac{5}{8}''$ in length, said butt extension further comprising: a threaded hole located on rear center of said butt extension as means of accepting previously mentioned stock extension tube, said tube having internal and external walls, being threaded externally on each end, said forward end being mated to said rear end threaded hole of said butt extension, said forward end of said tube being secured into said butt extension, said tube further comprising: a threaded end to accommodate aforementioned extension tube collet, said collet designed to accept aforementioned stock extension shaft, said stock extension shaft further comprising: a forward and rear end having a screwdriver tip ground onto said forward end, and a "T" configuration on rear end, said "T" end having calibrated square grooves machined into said "T" end to be used as tightening areas to fully secure all said barrel assembly parts.

* * * * *